US006155384A

United States Patent [19]

Paglioli

[11] Patent Number: 6,155,384

[45] Date of Patent: Dec. 5, 2000

[54] BREAK-FALL DEVICE WITH IMPROVED BRAKING

[75] Inventor: Luca Paglioli, Milan, Italy

[73] Assignee: S. S. E. Sistemi Di Sicurezza Europa S.r.l., Cisano Bergamasco, Italy

[21] Appl. No.: 09/107,584

[22] Filed: Jun. 11, 1998

[51] Int. Cl.[7] ..... B65H 59/16

[52] U.S. Cl. ..... 188/65.2; 188/65.5

[58] Field of Search ..... 188/65.1, 65.2, 188/65.3, 65.4, 65.5

[56] References Cited

U.S. PATENT DOCUMENTS

| | | | |
|---|---|---|---|
| 4,521,000 | 6/1985 | Dodge, Jr. | 188/65.2 |
| 4,669,582 | 6/1987 | Sandreid | 188/65.1 |
| 5,156,240 | 10/1992 | Ostrobrod | 188/65.1 |
| 5,265,696 | 11/1993 | Casebolt | 188/65.2 |
| 5,360,083 | 11/1994 | Hede | 188/65.4 |

FOREIGN PATENT DOCUMENTS

| | | | |
|---|---|---|---|
| 0 046 891 A2 | 8/1981 | European Pat. Off. | A62B 1/14 |
| 3029217 A1 | 8/1980 | Germany | A62B 1/08 |
| WO 91/00121 | 1/1991 | WIPO | A62B 35/04 |

*Primary Examiner*—Robert J. Oberleitner
*Assistant Examiner*—Devon Kramer
*Attorney, Agent, or Firm*—Cobrin & Gittes

[57] ABSTRACT

Break-fall device of a type used in conjunction with a lifeline and carabiner hook or similar manner of attachment to a harness, having at least one floating cam and one fixed cam, both enclosed in an external metallic shell, to define a path for the lifeline which can be blocked by the floating cam in case of a fall. The device includes manual controlled rotation of the floating cam around its pivot in the direction opposite to that locking the lifeline.

14 Claims, 4 Drawing Sheets

Fig. 1
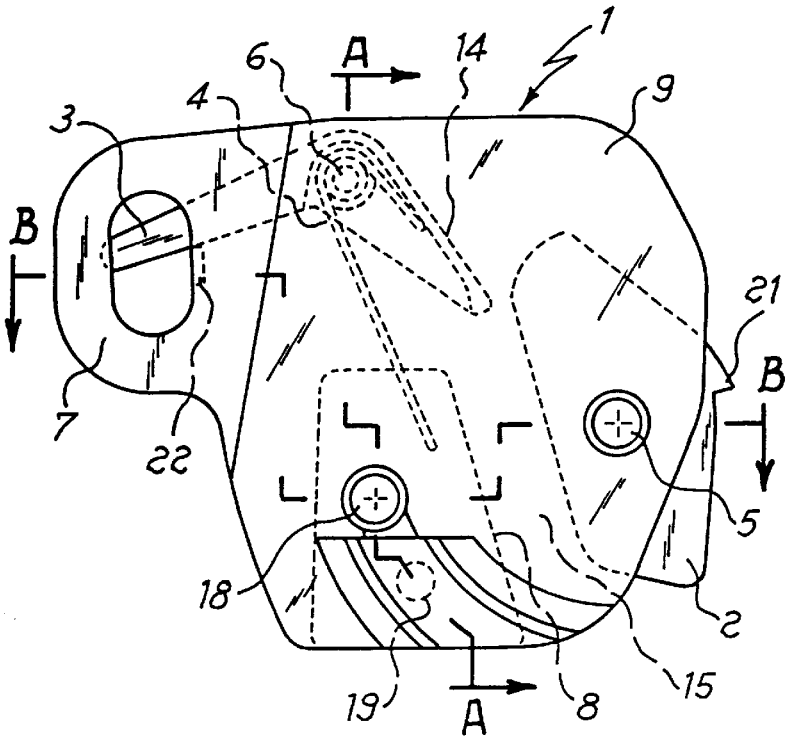
Fig. 2
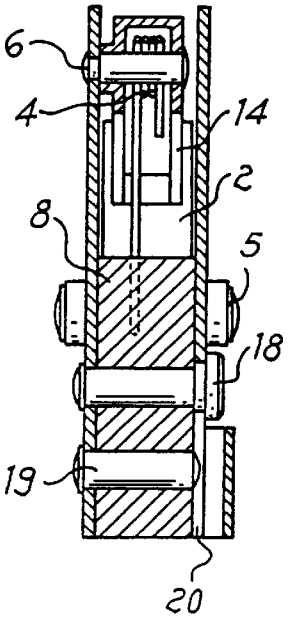
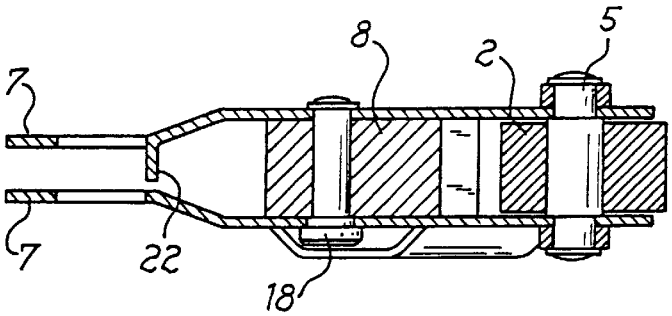
Fig. 3
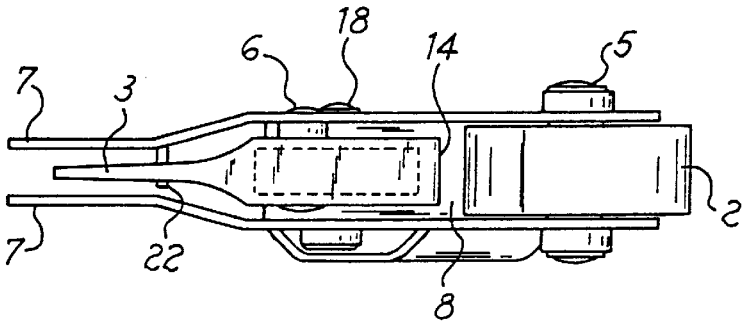
Fig. 4

BREAK-FALL DEVICE WITH IMPROVED BRAKING

TECHNICAL FIELD

The present invention relates to a break-fall safety device for use in the fields of industrial accident prevention and mountaineering In particular, the present invention relates to a break-fall device used in conjunction with a lifeline secured at its upper end and hanging freely, together with a carabiner harness hook.

BACKGROUND ART

There are devices in the prior art which break the fall of somebody operating at a height e.g. on the external wall of a building, in shipyards, in rescue situations or in mountaineering sports, where that person is fitted with a safety harness and lifeline.

The known devices comprise an opening element, which is substantially cylindrical when closed in use and through which the lifeline is free to run under normal working conditions.

A portion of the wall of the cylindrical element comprises a floating or swinging cam with a knurled or ribbed face which is in its turn linked by a suitable means to the user's harness. When a fall occurs, the weight of the person (who falls faster than the cylindrical element movement along the lifeline) acts on the cam and causes it to rotate so as to force the knurled face against the lifeline, slowing the run of the line through the cylindrical element and arresting the fall of the wearer.

Such devices present the following drawbacks: the weight of the user acts directly on the cam in such a way as to make it very difficult to unblock the run of the line, once the fall has been arrested and this prevents the person from descending unaided. The presence of knurling on the face of the cam could damage the lifeline, the instant the device starts to operate, due to friction between cam and line. Such devices do not have a means of reducing the time to break the fall and cannot guarantee optimum safety.

DISCLOSURE OF THE INVENTION

The aim of the present invention is to resolve the aforementioned difficulties by means of a break-fall device which allows the user alone to unblock the lifeline, does not damage the line itself needlessly and is safe and economical.

These objectives are achieved by the present invention, which relates to a break-fall device, of the type used in conjunction with a lifeline and a carabiner hook or similar means of attachment to a safety harness, and comprising at least one floating cam and a fixed counter-cam, both enclosed in an external metallic shell, which define a passage for the said lifeline which is blocked by the action of the floating cam in the event of a fall, characterized by comprising a means of rotating the said floating cam manually and in a controlled manner in a direction opposite to that blocking the lifeline.

According to a preferred embodiment of the present invention, the cam surface is substantially smooth, at least in the area coming into contact with the lifeline.

According to another preferred embodiment of the present invention, the break-fall device presents an entry gate pivoted on a pin and provided with a means of springing to force the gate against the lifeline, thus forcing the latter against the floating cam, which causes the cam to move in a direction which blocks the lifeline sooner than the action on the cam of the fall alone.

The present invention has the following advantages: firstly, the user can use a lever which forms part of the device (and can be carried in a zipper pocket or other stowage on the harness or be incorporated in the device itself) to gradually release the lifeline and allow a controlled descent; the face of the cam is smooth and has no knurling or other surface effects which might damage the lifeline itself either in operation during an emergency or in the subsequent controlled descent; the device according to the present invention arrests the fall in a very short time thus ensuring a higher level of safety. The device could be used as a descender i.e. in conjunction with the lifeline and carabiner harness hook to descend substantially vertical walls or other faces without footholds, when no alternative means of descent is available.

BEST MODE FOR CARRYING OUT THE INVENTION

The invention will now be described in more detail with reference to the attached drawings which are of an illustrative but not limiting nature, and in which:

FIG. 1 is a partially transparent front view of the break-fall device according to the present invention, in the closed position;

FIG. 2 is a section view of the device along A—A of FIG. 1;

FIG. 3 is a section view of the device along B—B of FIG. 1;

FIG. 4 is a top view of the device in FIG. 1;

Figure 5:
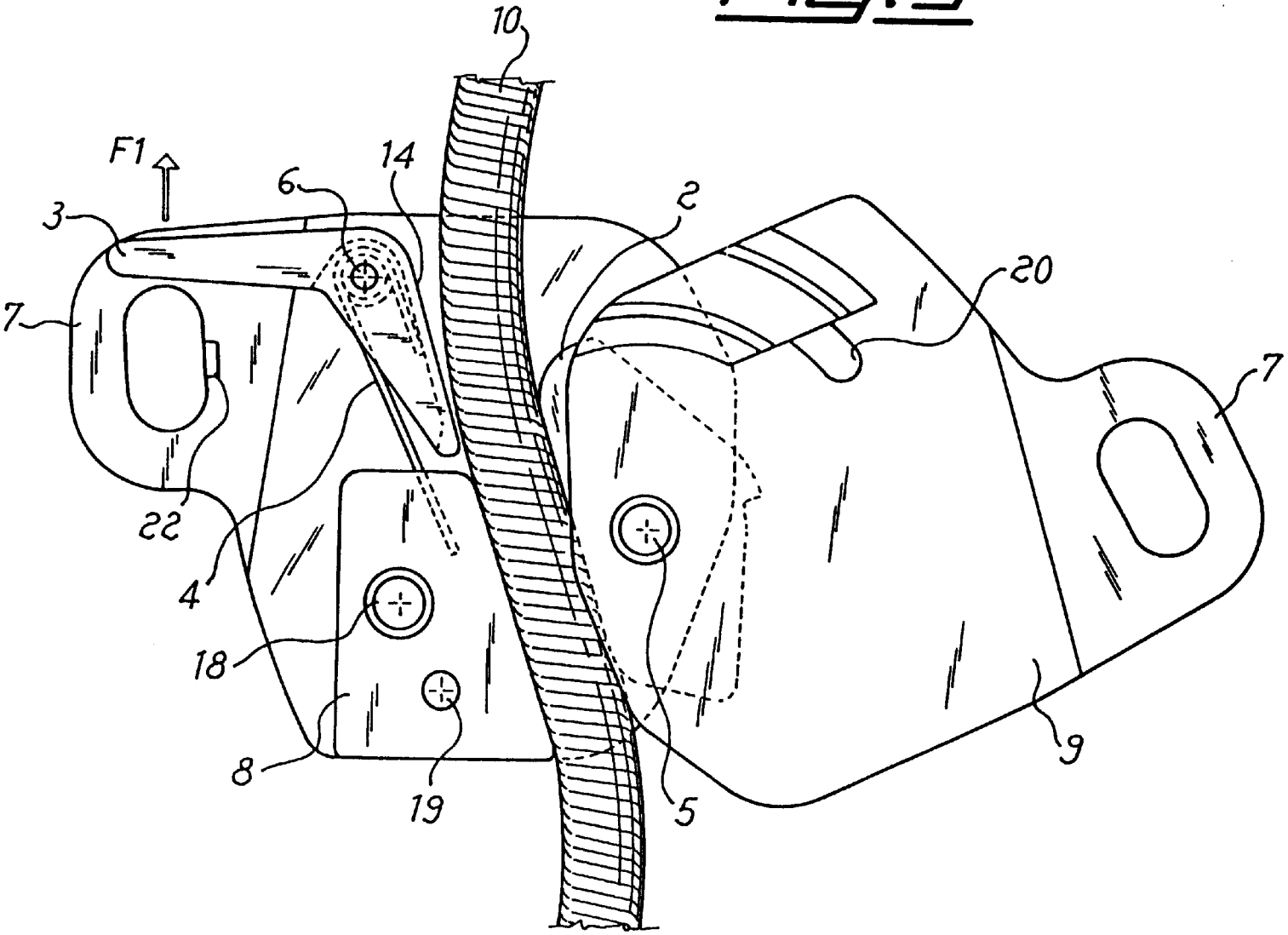
FIG. 5 is a partially transparent front view of the break-fall device according to the present invention, in the open position, showing part of the lifeline.

FIG. 1 shows the break-fall device 1 according to the present invention in a closed position, without the lifeline or carabiner hook. The device 1 is enclosed in an external metal shell 9 comprising two substantially similar elements which rotate with respect to each other in the plane of the drawing about the pivot 5, to allow the device 1 to open for the insertion and removal of the lifeline. There is a floating cam 2 inside the device 1 rotating on the pivot 5 and having a tooth 21 whose function will be explained below. With the expression "floating cam" in the present description is intended a cam that can move from at least two different positions through a rotation and/or a translation. There is a fixed element or counter-cam 8 in opposition to the cam 2; in use, the lifeline (not shown in FIG. 1) runs through the passage 15 defined by the cam 2 and the counter-cam 8. The counter-cam 8 is fixed to one of the two elements of the shell 9 by the pins 18 and 19, the former being fitted with a means of engaging with a cutout in the other part of the shell 9. The device 1 also has a gate 14 which can rotate on the pivot 6 and is tensioned by the coil spring 4, which bears against a cutout in the body of the gate and a fixed point on the frame. The gate 14 has a lever 3 which in FIG. 1 partially obstructs the apertures of the rings 7 through which the carabiner harness hook is fitted (not shown). The rotation of the gate 14 is limited by lever 3 bearing against the stop 22.

FIG. 2 shows a section through the device 1 along the line A—A of FIG. 1. The coil spring 4 with its extension and the slot cut into the gate 14 which rotates about the pivot 6 are visible in particular, as are the two pins 18 and 19 in section.

FIG. 3 shows a section through the device 1 along the line B—B of FIG. 1. The pivot 5, the pin 18 and parts of the cam 2 and counter-cam 8 in section are visible in particular, as is the section of the rings 7 through which the carabiner harness hook is fitted (not shown).

FIG. 4 shows a top view of the device 1; the lever 3 of the gate 14 between the two rings 7, the pivots 5 and 6, the pin 18, the upper surface of the cam 2 and the stop 22 are visible.

FIG. 5 shows the device open, i.e one part of the shell 9 has been rotated with respect to the other about the pivot 5. The lifeline 10 is shown passing through the device along the route between the cam 2 and the counter-cam 8. The gate 14 (whose function is described below) is shown under the influence of a force acting on the lever 3 in the direction of the arrow F1. This force results from the position of the harness hook while the wearer is involved in normal activity. The gate is held back against the action of the coil spring 4, allowing the lifeline 10 to run freely through the device. The cutout 20, in which a raised section of the pin 18 engages, is also visible.

Figure 6:
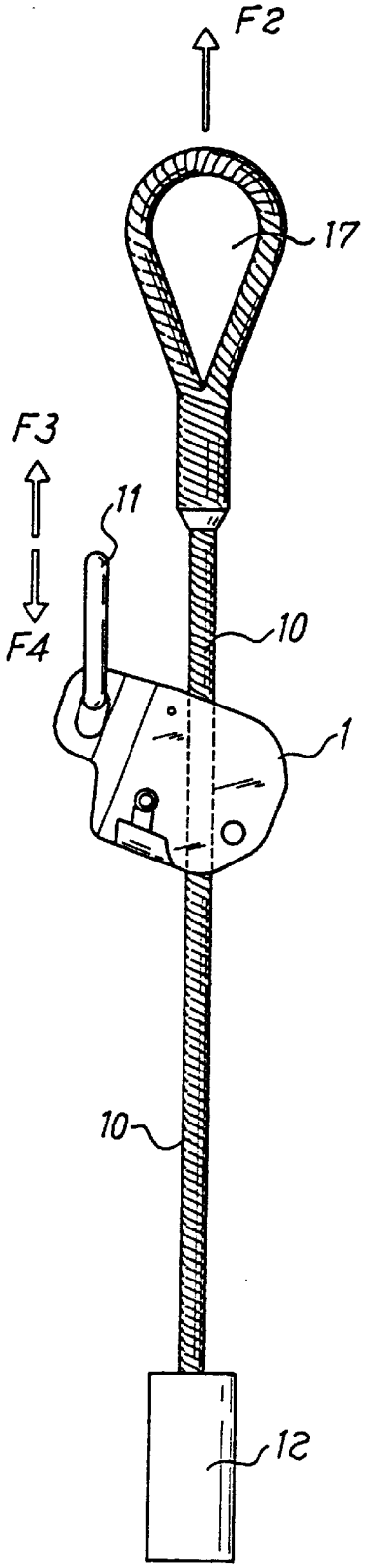
FIG. 6 is a front view of the break-fall device according to the present invention in conjunction with the lifeline and carabiner harness hook showing operating position during normal activity of the user.

FIG. 6 is a front view in the vertical plane of the device 1 operating in conjunction with the lifeline 10, carabiner harness hook 11 and counterweight 12 while the wearer is involved in normal activity. Presuming the eye 17 of the lifeline 10 is securely anchored to a fixed point (not shown) causing a reaction force in the direction of the arrow F2, the harness hook 11 will be subject to the forces F3 and F4 due to the movement of the user involved in normal activity. As has already been shown the weight of the device will cause the hook to maintain the lever 3 in a position where the gate 14 frees the lifeline 10 thus allowing the device 1 to run freely along the same line.

Figure 7:
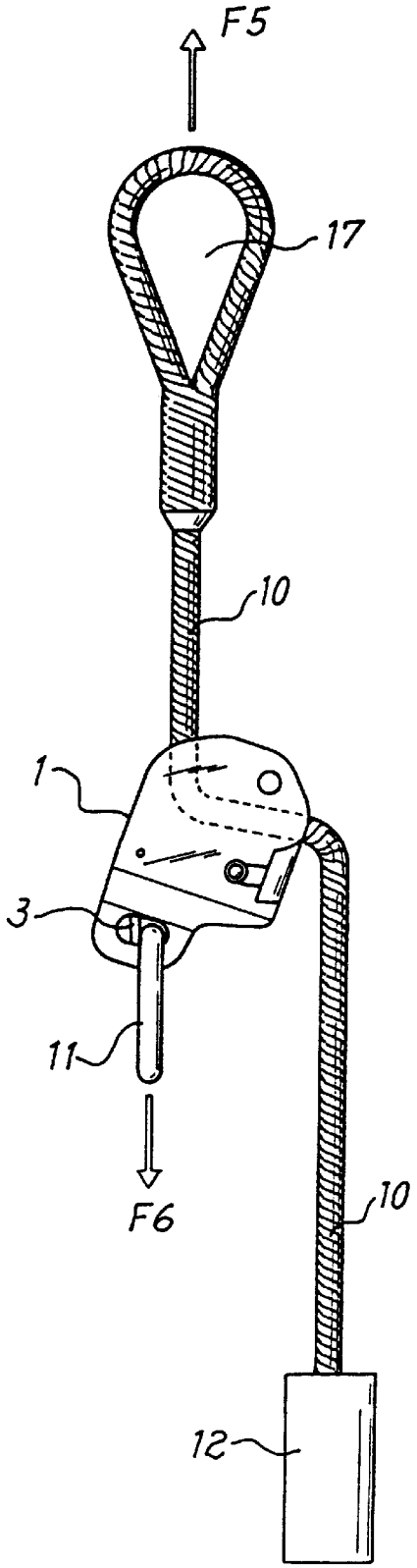
FIG. 7 is a front view of the break-fall device according to the present invention in conjunction with the lifeline and carabiner harness hook showing operating position immediately after arrest of a fall.

FIG. 7 is a front view in the vertical plane similar to FIG. 6. It shows the position of the device 1 after the arrest of a fall. The weight of the user acting on the hook 11 in the direction of the arrow F6, in the opposite direction of the reaction force directed as the arrow F5, rotates the device 1 thus releasing the lever 3 of the gate 14. The spring 4 of gate 14, released from the effect of a force such as F1 of FIG. 5, rotates the gate 14 towards the lifeline 10. The line 10 is thus subjected to an initial—though small—friction force, but more particularly it is driven against the upper part of the face of the cam 2 initiating its rotation about the pivot 5. The tail of the cam is forced to press the lifeline A towards the counter-cam 8, blocking the run of the lifeline and breaking the fall of the user.

It is important to note that the part of the cam 2 which comes into contact with the lifeline is substantially smooth and is not knurled or ribbed in any way which might cause damage to the lifeline during the arrest of the fall or in the emergency descent (described below).

Figure 8:
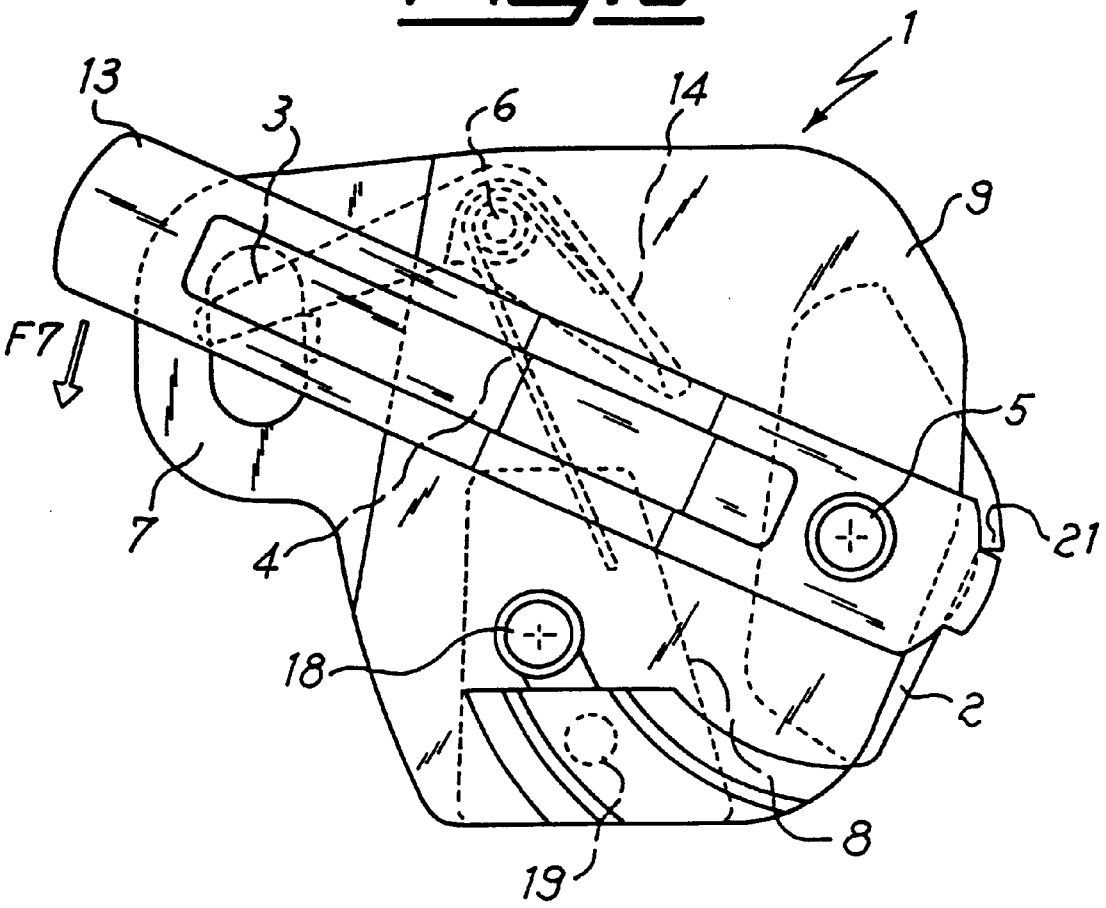
FIG. 8 is a partially transparent front view of the break-fall device according to the present invention, showing the cam-releasing lever.

FIG. 8 is a partially transparent front view of the device 1 fitted with the cam-release lever 13. During normal work activity the lever 13 can be kept in a closed pocket or in some other stowage. In an emergency, the user can release the lifeline by engaging the lever 13 on the pivot 5, and rotating it in the direction of the arrow F7. The end part of the lever 13 engages the tooth 21 on the cam 2. Rotation of the lever 13 in the direction of the force F7 rotates the cam 2 about the pivot 5 and lifts the tail of the cam from the lifeline. The device can then run along the lifeline without dangerous jerks, since the speed of descent can be regulated in this manner, allowing the user to descend alone unaided.

Figure 9:
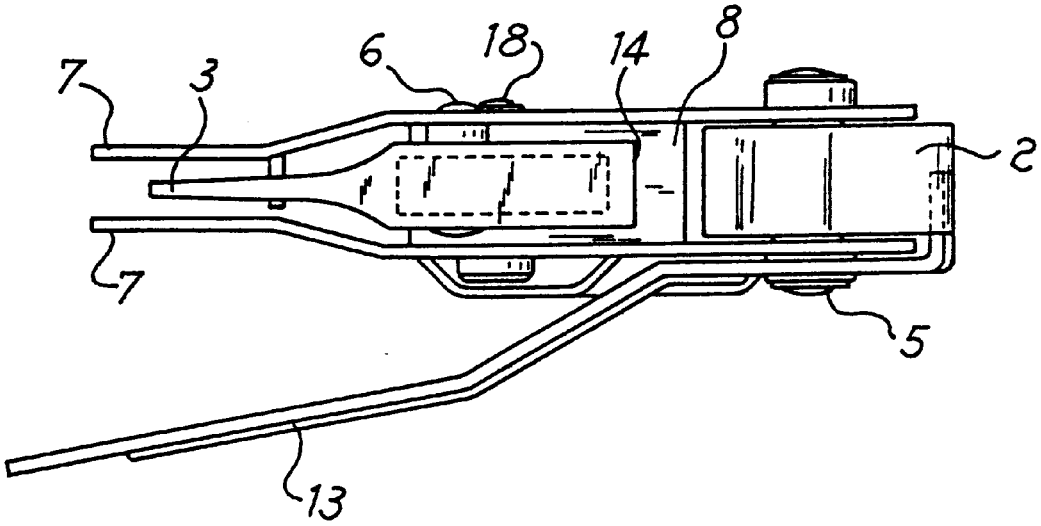
FIG. 9 is a partially transparent top view of the break-fall device according to the present invention, showing the cam-releasing lever.

FIG. 9 is a partially transparent top view similar to FIG. 4. of the device 1 fitted with the release lever 13.

The preceding description refers to a device which opens to allow device to be fitted to the lifeline, but another embodiment of the device, similar to that already described, does not open. In that case the lifeline must be threaded through the device 1 by inserting it into the space between the gate 14 and the cam 2, which can be seen in FIG. 4.

What is claimed is:

1. Break-fall device of the type used in conjunction with a lifeline and carabiner hook to attach it to a harness, comprising at least one floating cam and a fixed counter-cam, both enclosed in an external shell, which define a passage for the lifeline which is blocked by the action of the floating cam in the event of a fall, characterized by comprising a means of rotating the floating cam about a pivot manually and in a controlled manner, in a direction opposite to that blocking the lifeline the pivot being pivotably fixed to the external shell.

2. Break-fall device according to claim 1, characterized by the means of controlled manual rotation of the cam being a lever which engages cam.

3. Break-fall device according to claim 1, characterized by the floating cam being mounted free to rotate enclosed in a metallic shell which in its turn is bound to the harness.

4. Break-fall device according to claim 3, characterized by the floating cam presenting a substantially smooth surface, at least in the area which comes into contact with the lifeline.

5. Break-fall device according to claim 3, characterized by the floating cam having a tooth to allow the lever to engage and rotate the same cam in a direction opposite to that blocking the lifeline.

6. Break-fall device according to claim 5, characterized by the tooth for the manual control of the cam being located on a side opposite carabiner hook rings.

7. Break-fall device according to claim 1, characterized by the device having an entry gate pivoted on a pin and provided with a means of springing to force the gate against the lifeline, thus forcing the latter against the floating cam, which causes the cam to move in a direction which blocks the lifeline sooner than the action on the cam of the fall alone.

8. Break-fall device according to claim 7, characterized by the entry gate being held, under normal operating conditions for the device, in a position of disengagement from the lifeline by the action of the carabiner hook or similar means of attachment on a lever extension of the same gate, overcoming the resistance of the means of springing.

9. Break-fall device according to claim 1, characterized by the external metallic shell being capable of opening and having two rings in a position opposite that of the floating cam, for the attachment of the carabiner hook.

10. Break-fall device according to claim 1, characterized by the external metallic shell not being capable of opening.

11. Break-fall device according to claim 1, characterized by the harness is worn by a user, the fall is of the user, the passage runs freely in up and down directions through the device when a weight of the user is not supported by the lifeline, the passage being substantially rectilinear.

12. A break-fall method of the type used in conjunction with a lifeline and a carabiner hook or similar to attach to a harness worn by a user, comprising running a lifeline freely in up and down directions through a passage, which is defined by at least one floating cam and a fixed counter-cam both enclosed in an external shell, when a weight of the user is not supported by the lifeline, blocking the lifeline by action of the floating cam in the event of a fall by the user, the passage being substantially rectilinear and the rotating cam rotating about a pivot manually and in a controlled manner in a direction opposite to that blocking the lifeline the pivot being pivotably fixed to the external shell.

13. A method as in claim 12, further characterized by springing to force an entry gate against the lifeline and thus the latter against the floating cam, which causes the cam to move in a direction which blocks the lifeline sooner than action on the cam of the fall alone.

14. A method as in claim 13, further characterized by holding the entry gate in a position of disengagement from the lifeline to overcome resistance of the springing under normal operating conditions in the absence of the fall by the user.

* * * * *